US009972157B2

(12) United States Patent
Asada

(10) Patent No.: US 9,972,157 B2
(45) Date of Patent: May 15, 2018

(54) PAPER SHEET HANDLING SYSTEM AND PAPER SHEET HANDLING METHOD

(71) Applicant: GLORY LTD., Himeji-shi, Hyogo-ken (JP)

(72) Inventor: Toshihide Asada, Himeji (JP)

(73) Assignee: GLORY LTD., Himeji-shi, Hyogo-ken (JP)

( * ) Notice: Subject to any disclaimer, the term of this patent is extended or adjusted under 35 U.S.C. 154(b) by 199 days.

(21) Appl. No.: 14/786,709

(22) PCT Filed: Apr. 25, 2013

(86) PCT No.: PCT/JP2013/062211
§ 371 (c)(1),
(2) Date: Oct. 23, 2015

(87) PCT Pub. No.: WO2014/174632
PCT Pub. Date: Oct. 30, 2014

(65) Prior Publication Data

US 2016/0093132 A1 Mar. 31, 2016

(51) Int. Cl.
*B65H 26/00* (2006.01)
*G07D 11/00* (2006.01)
*B65H 33/14* (2006.01)

(52) U.S. Cl.
CPC ..... *G07D 11/0084* (2013.01); *B65H 26/00* (2013.01); *B65H 33/14* (2013.01); *G07D 11/0021* (2013.01)

(58) Field of Classification Search
CPC ..... G07D 11/0084; G07D 11/0021; B65H 26/00; B65H 33/14
(Continued)

(56) References Cited

U.S. PATENT DOCUMENTS 3,759,382 A * 9/1973 Walkley ..... B65H 29/62 209/534
3,938,663 A * 2/1976 Carnes ..... G07D 7/12 209/534
(Continued)

FOREIGN PATENT DOCUMENTS

GB 2 085 412 A 4/1982
JP 5-54230 A 3/1993
(Continued)

OTHER PUBLICATIONS

European Search Report (Application No. 13883117.7—PCT/JP2013/062211) (7 pages—dated Dec. 13, 2016).
(Continued)

*Primary Examiner* — Patrick H Mackey
(74) *Attorney, Agent, or Firm* — Renner, Kenner, Greive, Bobak, Taylor & Weber

(57) ABSTRACT

A paper sheet handling system includes a reception unit 11 configured to receive a plurality of paper sheets, a taking-in unit 10 configured to take in, one by one, the paper sheets received by the reception unit 11, a recognizing and counting unit 55 configured to recognize and count the paper sheets taken in by the taking-in unit 10, a handling unit configured to handle the paper sheets recognized by the recognizing and counting unit 55, the handling unit including stackers 60*a* to 60*d*, rejection units 61*a* and 61*b*, a bundling unit 250, a transport unit 70, and a cassette storing unit 300, and an operation/display unit 59 configured to input a confirmation signal for confirming count data on the paper sheets recognized by the recognizing and counting unit 55. The paper sheet handling system 100 is configured to accept the confirmation signal from the operation/display unit 59 on a condition that the last paper sheet is recognized by the recognizing and counting unit 55.

16 Claims, 5 Drawing Sheets

(58) Field of Classification Search
USPC ..... 270/58.02, 58.05
See application file for complete search history.

(56) References Cited

U.S. PATENT DOCUMENTS 4,402,410 A * 9/1983 Ohba ..... B65B 27/08 209/534
4,437,571 A * 3/1984 Ohmura ..... G07D 7/04 209/534
5,207,412 A * 5/1993 Coons, Jr. ..... B42C 1/10 270/1.02
5,704,602 A * 1/1998 Taylor ..... B65H 33/04 270/1.02
5,704,604 A * 1/1998 Koelle ..... B65H 29/18 270/52.07
7,066,384 B2 * 6/2006 Yokoi ..... G07D 11/0066 235/379
7,100,911 B2 * 9/2006 Middelberg ..... B65H 39/06 270/52.02
8,356,747 B2 * 1/2013 Sudo ..... G07D 11/0084 194/206

FOREIGN PATENT DOCUMENTS

| | | | |
|---|---|---|---|
| JP | 2001-236548 | A | 8/2001 |
| JP | 2012-64826 | A | 3/2012 |
| JP | 2012-190236 | A | 10/2012 |
| WO | WO 2010/067421 | A1 | 6/2010 |
| WO | WO 2010/097954 | A1 | 9/2010 |
| WO | WO 2013/183166 | A1 | 12/2013 |

OTHER PUBLICATIONS

Chinese Office Action with English Translation (Application No. 201380075938.3) (10 pages—dated Feb. 16, 2017).

* cited by examiner

PAPER SHEET HANDLING SYSTEM AND PAPER SHEET HANDLING METHOD

TECHNICAL FIELD

The present invention relates to a paper sheet handling system configured to handle paper sheets such as banknotes, checks, gift certificates, and ledger sheets, and a paper sheet handling method for handling paper sheets.

BACKGROUND ART

Paper sheet handling machines configured to handle paper sheets have been known. An example of such machines is a paper sheet deposit handling machine, which confirms the number of paper sheets deposited in sequential deposit transactions in units of transactions. More specifically, a paper sheet deposit handling machine is known, which includes a deposit unit through which paper sheets are deposited, a transport unit configured to feed and transport, one by one, the paper sheets deposited into the deposit unit, a stacker configured to sort and stack the paper sheets sequentially transported by the transport unit, a bundling-object paper sheet stacker configured to sequentially sort and stack paper sheets of a specified denomination to be bundled, a paper sheet bundling unit configured to bundle a predetermined number of bundling-object paper sheets when the number of bundling-object paper sheets sorted and stacked in the bundling-object paper sheet stacker reaches a predetermined number, and a confirmation unit configured to confirm, when detecting a transaction end operation, the number of paper sheets stacked in the stacker and the bundling-object paper sheet stacker as the total number of deposited paper sheets in the current transaction (see WO 2010/067421).

DISCLOSURE OF THE INVENTION

Technical Problem

However, conventional paper sheet handling machines confirm the amount of deposited paper sheets only after the handling operations such as the stacking in the stacker and the bundling in the bundling unit are completed in a handling unit. In order to reliably confirm the deposited amount in one transaction, the conventional paper sheet handling machines do not start a new transaction until the amount of deposited paper sheets is confirmed. Specifically, the conventional paper sheet handling machines do not deposit paper sheets for a new transaction, or input transaction data for a new transaction.

Since no new transaction is performed until the handling operations such as the stacking and the bundling are completed in the conventional paper sheet handling machines, the conventional paper sheet handling machines have failed to achieve a high level of work efficiency. The low level of work efficiency caused by not being able to start a new transaction is a remarkable problem in paper sheet handling centers that handle, at a time, paper sheets relating to a large number of transactions.

The present invention is proposed in consideration of this point, and provides a paper sheet handling system, which is capable of receiving paper sheets deposited for a new transaction, and receiving transaction data with respect to the new transaction before the handling operations in a handling unit are completed, in order to improve the work efficiency in deposit operations and the like, and a paper sheet handling method for the paper sheet handling system.

Solution to Problem

A paper sheet handling system according to the present invention includes:

a reception unit configured to receive a plurality of paper sheets;

a taking-in unit configured to take in, one by one, the paper sheets received by the reception unit;

a recognizing and counting unit configured to recognize and count the paper sheets taken in by the taking-in unit;

a handling unit configured to handle each of the paper sheets recognized by the recognizing and counting unit; and an input unit configured to input a confirmation signal for confirming count data with respect to each of the paper sheets recognized by the recognizing and counting unit, wherein the confirmation signal from the input unit is accepted when a last paper sheet is recognized by the recognizing and counting unit.

The paper sheet handling system according to the present invention may further include a rejection unit configured to store a paper sheet to be rejected, wherein the confirmation signal from the input unit may be accepted on a condition that no rejected paper sheet is present in the rejection unit.

The paper sheet handling system according to the present invention may be configured such that transaction information relating to each of the paper sheets received or to be received by the reception unit is inputted from the input unit, and that the confirmation signal from the input unit is accepted on a condition that the transaction information is inputted.

The paper sheet handling system according to the present invention may be configured such that the handling unit includes a stacker for stacking and storing each of the paper sheets, and that the confirmation signal from the input unit is accepted while the paper sheets are being stacked by the stacker.

The paper sheet handling system according to the present invention may be configured such that the handling unit includes a bundling unit configured to bundle a predetermined number of paper sheets, and that the confirmation signal from the input unit is accepted while the paper sheets are being bundled by the bundling unit.

The paper sheet handling system according to the present invention may be configured such that the handling unit includes a transport unit configured to transport the paper sheets, and the confirmation signal from the input unit is accepted while the paper sheets are being transported by the transport unit.

The paper sheet handling system according to the present invention may be configured such that the handling unit includes a storage unit for storing the paper sheets, and that when each of the paper sheets received by the reception unit is transported to the storage unit to perform a deposit operation, the last paper sheet is a paper sheet received by the reception unit and taken in by the taking-in unit in the last place.

The paper sheet handling system according to the present invention may be configured such that the handling unit includes a storage unit for storing the paper sheets, and that when each of the paper sheets received by the reception unit is transported to the storage unit to perform a withdrawal operation, the last paper sheet is a paper sheet with which the total amount of the paper sheets recognized by the recognizing and counting unit reaches the predetermined amount.

The paper sheet handling system according to the present invention may further include a notification unit configured to provide a notification indicating that the confirmation signal can be accepted from the input unit.

The paper sheet handling system according to the present invention may further include a notification unit configured to provide a notification, which indicates that the paper sheets can be received by the reception unit, when the confirmation signal is inputted from the input unit.

A paper sheet handling method according to the present invention uses a paper sheet handling system and includes:

receiving, by a reception unit of the paper sheet handling system, a plurality of paper sheets;

taking in, one by one, by a taking-in unit of the paper sheet handling system, the paper sheets received by the reception unit;

recognizing, by a recognizing and counting unit of the paper sheet handling system, each of the paper sheets taken in by the taking-in unit;

handling, by a handling unit of the paper sheet handling system, each of the paper sheets recognized by the recognizing and counting unit; and inputting, by an input unit of the paper sheet handling system, a confirmation signal for confirming count data relating to the paper sheets recognized by the recognizing and counting unit, wherein the confirmation signal from the input unit is accepted on a condition that a last paper sheet is recognized by the recognizing and counting unit.

Advantageous Effects of Invention

According to the present invention, a confirmation signal from the input unit is accepted on the condition that the last paper sheet is recognized by the recognizing and counting unit. Accordingly, paper sheets relating to a new transaction may be deposited and transaction data relating to the new transaction may be inputted before the handling of the handling unit is completed in the paper sheet handling system. As a result, the work efficiency may be improved in a deposit operation and a withdrawal operation.

BEST MODE FOR CARRYING OUT THE INVENTION

Embodiments

<<Structure>>

Hereinafter, embodiments of the paper sheet handling system and the paper sheet handling method according to the present invention will be described with reference to the accompanying drawings. FIGS. 1 to 5 are the drawings for describing the embodiments of the present invention.

In the descriptions of the present invention, the term "paper sheet handling system" also represents one "paper sheet handling machine." Therefore, the term "paper sheet handling system" in the claims may represent a paper sheet handling machine 100 itself, and also a combination of the paper sheet handling machine 100 and other devices. Hereinafter, an aspect in which the term "paper sheet handling system" represents the paper sheet handling machine 100 itself will be mainly described. In the descriptions of the present invention, the term "paper sheet" may represent "banknote," "check," "gift certificate," and other paper sheets. A typical paper sheet is a banknote.

Figure 1:
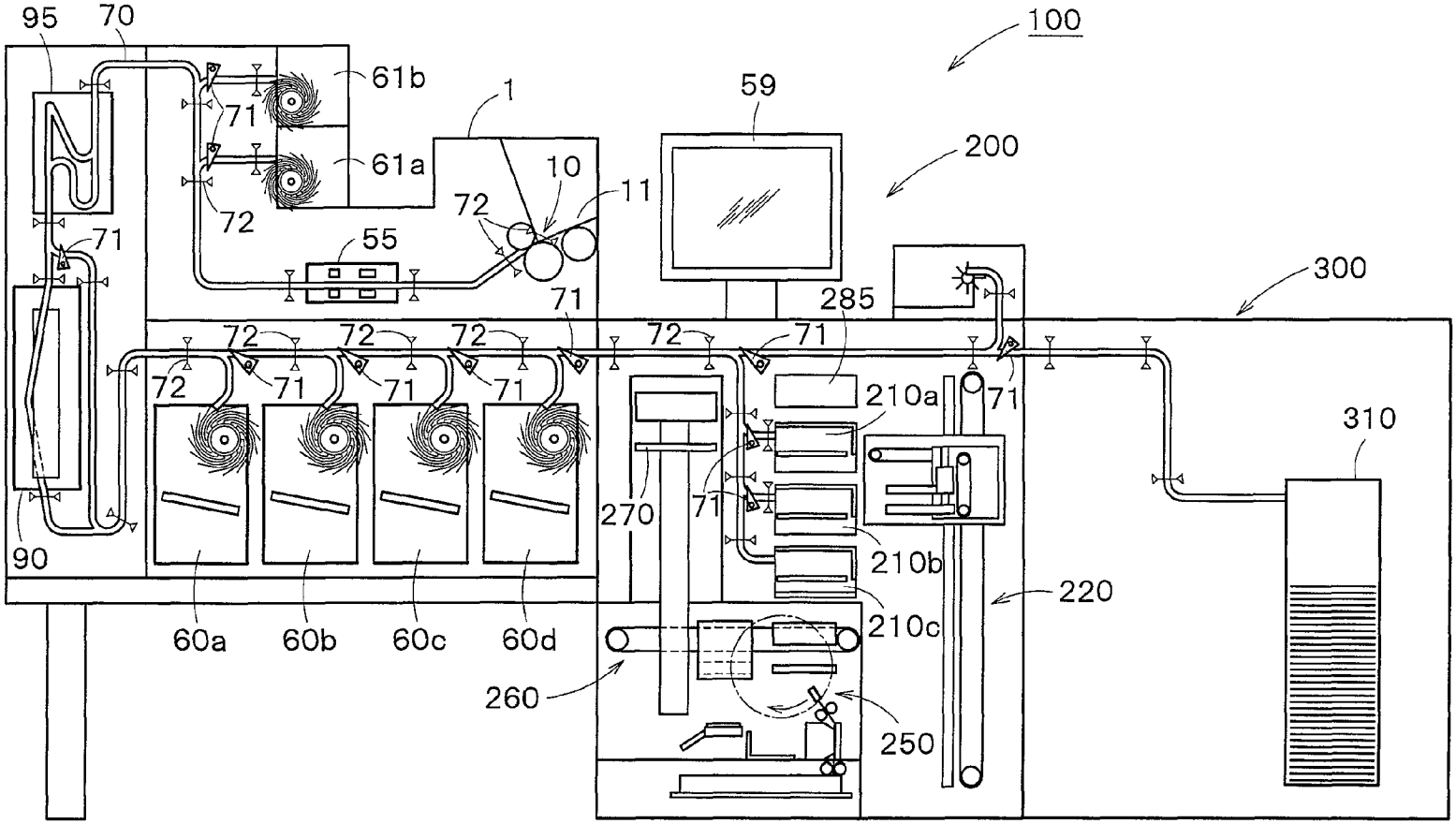
FIG. 1 is a side cross-section of a paper sheet handling machine according to an embodiment of the present invention, illustrating the structure thereof.

As shown in FIG. 1, the paper sheet handling machine 100 according to the embodiment includes a housing 1, a reception unit 11 disposed to the housing 1 for receiving a plurality of paper sheets, a taking-in unit 10 for taking in, one by one, the paper sheets received by the reception unit 11, a transport unit 70 for transporting the paper sheets taken in to the housing 1 by the taking-in unit 10, a recognizing and counting unit 55 for recognizing and counting the paper sheets transported by the transport unit 70, a plurality of stackers 60*a* to 60*d* for stacking the paper sheets recognized by the recognizing and counting unit 55, and rejection units 61*a* and 61*b* for rejecting the paper sheets that are not to be stacked in the stackers 60*a* to 60*d*. The recognizing and counting unit 55 according to the embodiment recognizes banknotes by, for example, the denomination, the fitness, the face note or back note, the version, the direction, and the authentication of banknotes. The stackers 60*a* to 60*d* of the embodiment have openings at their front side. Accordingly, the operator may freely take out the paper sheets from the stackers 60*a* to 60*d*.

The paper sheet handling machine 100 according to the embodiment also includes a paper sheet bundling unit 200 for bundling a predetermined number, for example 100, of paper sheets, and a cassette storing unit 300 including a cassette 310, in which the paper sheets may be stacked and stored. The cassette 310 is attachable to and detachable from the cassette storing unit 300. For example, 1000 banknotes may be stacked in the cassette 310. The cassette 310 is also attachable to and detachable from other paper sheet handling machines, for example ATMs. If the cassette 310 is attached to an ATM, the banknotes stored in the cassette 310 may be used to be withdrawn from the ATM.

The transport unit 70 includes a plurality of diverter members 71 for appropriately diverting the courses of the paper sheets transported by the transport unit 70, as shown in FIG. 1. The transport unit 70 also includes a plurality of sensors 72 for sensing the paper sheets passing through the transport unit 70, and sensing the presence of the paper sheets. The sensors 72 disposed to the reception unit 11 are used for determine whether there is one or more paper sheets in the reception unit 11.

The paper sheet handling machine 100 according to the embodiment also includes paper sheet reversing units 90 and 95 for reversing the paper sheets. The paper sheet reversing units 90 and 95 includes a short edge reversing unit 95 for performing face/back reversal to change the orientations of the short edges of the paper sheets transported in the short edge direction by the transport unit 70, and a long edge reversing unit 90 for performing face/back reversal to change the orientations of the long edges of the paper sheets transported by the transport unit 70. The details of the method of reversing the paper sheets by the short edge reversing unit 95 and the long edge reversing unit 90 are disclosed in WO 2010/097954, and omitted herein.

The paper sheet bundling unit 200 according to the embodiment includes a plurality of paper-sheet-to-be-bundled stacking units 210*a* to 210*c* for stacking paper sheets to be bundled, which are transported by the transport unit 70, a bundling unit 250 for bundling the paper sheets stacked in the paper-sheet-to-be-bundled stacking units 210*a* to 210*c* to make paper sheet bundles, a before-bundling-paper-sheet transporting unit 220 for transporting, from the paper-sheet-to-be-bundled stacking units 210*a* to 210*c* to the bundling unit 250, the paper sheets to be bundled, a bundled paper sheet transporting unit 260 for transporting paper sheet bundles from the bundling unit 250, and a paper sheet bundle stacking unit 270 for storing the paper sheet bundles transported by the bundled paper sheet transporting unit 260. The paper sheet bundle stacking unit 270 may send the paper sheet bundles stored therein to a bundle outlet (not shown). The bundling unit 250 described above straps 100 paper sheets, for example, into a paper sheet bundle with a bundle band. The paper sheet bundle is finished by fastening the bundle band.

As shown in FIG. 1, the paper sheet bundling unit 200 also includes a remainder returning port 285, through which the remainder of the paper sheets stacked in the paper-sheet-to-be-bundled stacking units 210*a* to 210*c* is returned to the operator when the transaction ends.

The paper sheet handling machine 100 according to the embodiment also includes an operation/display unit 59 with, for example, a touch panel. The operation/display unit 59 is capable of displaying predetermined information, and inputting a confirmation signal for confirming count data with respect to the paper sheets recognized by the recognizing and counting unit 55. The operation/display unit 59 serves as the "input unit" recited in the claims.

The confirmation signal form the operation/display unit 59 is accepted on the condition that the last paper sheet is recognized by the recognizing and counting unit 55. The count data includes, for example, the total amount of the paper sheets, the number of paper sheets in each denomination, the number of fit notes, and the number of unfit notes.

Other conditions may be set to accept the confirmation signal from the operation/display unit 59, in addition to the recognition of the last paper sheet by the recognizing and counting unit 55. Examples of the conditions include the non-presence of paper sheet rejected by the rejection units 61*a* and 61*b*. If the operation/display unit 59 is capable of inputting transaction information on the paper sheet that is received or to be received by the reception unit 11, the input of this transaction information may be used as a condition. The above conditions may be combined to form a new condition that no rejected paper sheet is present in the rejection units 61*a* and 61*b*, and the transaction information is inputted. The transaction information may include, for example, the transaction ID, the name of depositor, the account number for the deposit, the total amount of paper sheets, and the number of paper sheets in each denomination.

Although the embodiment is described with respect to an aspect that the paper sheets rejected by the rejection units 61*a* and 61*b* are transported, the embodiment is not limited to this aspect, and, for example, the paper sheets rejected by any of the stackers 60*a* to 60*d* may be transported. In this case, the stackers 60*a* to 60*d* serve as the "rejection unit" recited in the claims.

The conditions may further include a case where the last paper sheet passes through a predetermined point during the transporting operation. In this case, the passing of the last paper sheet near a predetermined sensor 72 may be first detected based on the information from this sensor 72, and then the confirmation signal from the operation/display unit 59 may be accepted.

If the aforementioned conditions are met, the confirmation signal inputted from the operation/display unit 59 is accepted regardless of what operation the paper sheet handling machine 100 is performing. For example, the confirmation signal inputted from the operation/display unit 59 may be accepted while the paper sheets are being stacked in the stackers 60*a* to 60*d*, a predetermined paper sheets are being bundled by the bundling unit 250, the paper sheets are being transported by the transport unit 70, or the paper sheets are being stacked in the cassette 310.

Figure 2:
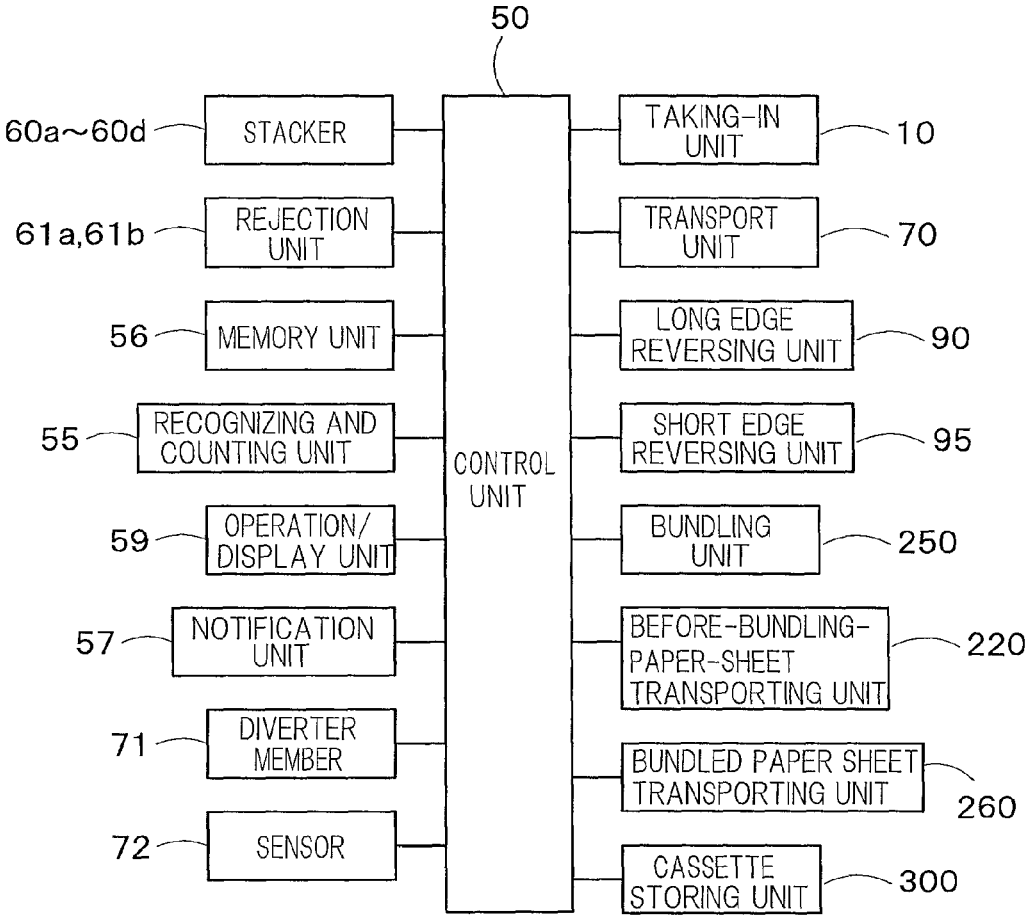
FIG. 2 is a functional block diagram illustrating the structure of the paper sheet handling machine according to the embodiment of the present invention.

The paper sheet handling machine 100 also includes a memory unit 56, as shown in FIG. 2, for storing various pieces of information including the confirmed count data.

As shown in FIG. 2, the paper sheet handling machine 100 may also include a notification unit 57 for the notification of various information. The notification may be provided from the notification unit 57 when the operation/display unit 59 is in a state to receive the confirmation signal, or when the reception unit 11 is ready to receive paper sheets after receiving the confirmation signal from the operation/display unit 59.

The operation/display unit 59 may serve as the notification unit. In this case, when the confirmation signal from the operation/display unit 59 is acceptable, a key indicating "transaction complete" may flash, or a key indicating "transaction complete," which has been displayed in a thin color, may be displayed in a deep color, or a key indicating "transaction complete," which has not been displayed, may appear. When the reception unit 11 is ready for receiving paper sheets, for example, a key indicating "receivable" may flash, or a key indicating "receivable," which has been displayed in a thin color, may be displayed in a deep color, or a key indicating "receivable," which has not been displayed, may appear.

If the operation/display unit 59 and the notification unit 57 are separate units, the state where the input of a confirmation signal from the operation/display unit 59 is ready, or the state where the reception unit 11 is ready to receive the paper sheets may be notified by the flashing or lighting of the notification unit 57 including an LED, or by voices from the notification unit 57.

In the above descriptions, the recognition of the last paper sheet by the recognizing and counting unit 55 is one of the conditions. The meaning of the "last paper sheet" will be described below, taking examples of deposit operation and withdrawal operation.

An example to perform a deposit operation will be first described, in which the paper sheets received by the reception unit 11 are transported to the storage unit including the stackers 60*a* to 60*d*, the paper-sheet-to-be-bundled stacking units 210*a* to 210*c*, and the cassette 310. In this case, the "last paper sheet" is the paper sheet that is taken in by the taking-in unit 10 in the last place among all the paper sheets received by the reception unit 11. The presence of a paper sheet in the reception unit 11 is detected by the sensor 72 disposed to the reception unit 11, and whether the paper sheet fed from the reception unit 11 is the "last paper sheet" is determined by a control unit 50 (that will be described later) based on the information from the sensor 72 disposed to the reception unit 11. Furthermore, the transporting state of the taken-in paper sheets may be monitored by detecting the passing of the paper sheets by the sensors 72 disposed to various points in the transport unit 70, including the sensors 72 disposed to the immediate downstream of the taking-in unit 10, and the recognizing and counting unit 55. The control unit 50 determines the "last paper sheet" based on the information from the sensors 72 and the recognizing and counting unit 55.

Specifically, when the "last paper sheet" of the paper sheets placed in the reception unit 11 is taken in, the output from the sensor 72 disposed to the reception unit 11 changes from the state indicating the presence of paper sheet to the state indicating the non-presence of paper sheet. Based on this information, the control unit 50 determines that no paper sheet remains in the reception unit 11. Furthermore, based on the information from the sensor 72 disposed in the immediate downstream of the taking-in unit 10, indicating the passing of paper sheet, the control unit 50 determines that the "last paper sheet" is taken in, and also specifies the "last paper sheet." The control unit 50 may detect the timing at which the "last paper sheet" passes through the recognizing and counting unit 55 by tracking the transport state of the "last paper sheet" by means of one or more sensors 72 disposed at respective points of the transport unit 70, more specifically one or more sensors 72 disposed between the taking-in unit 10 and the recognizing and counting unit 55. The control unit 50 allows the confirmation signal to be accepted on the condition that the "last paper sheet" is recognized by the recognizing and counting unit 55.

In the case where the paper sheets received by the reception unit 11 are transported to the storage unit including the stackers 60*a* to 60*d*, the paper-sheet-to-be-bundled stacking units 210*a* to 210*c*, and the cassette 310 to perform a withdrawal operation, the "last paper sheet" is the paper sheet with which the total amount of the paper sheets recognized by the recognizing and counting unit 55 reaches a predetermined amount. The predetermined amount is inputted by the operator from the operation/display unit 59, for example. The paper sheets such as banknotes that are withdrawn are used as the payment reserve in branches of financial institutions or the change in stores such as supermarkets. If the cassette 310 is caused to store only banknotes of a specified denomination, and a predetermined amount of banknotes is taken out from the cassette 310, the "last paper sheet" may be determined by the number of banknotes stored in the cassette 310. For example, the thousandth banknote recognized and counted by the recognizing and counting unit 55 may be the "last paper sheet." The control unit 50 may also determine the "last paper sheet" by calculating the total amount of the paper sheets such as banknotes recognized by the recognizing and counting unit 55 based on the denomination and the number of paper sheets. The control unit 50 allows the confirmation signal to be accepted on the condition that the "last paper sheet" is recognized by the recognizing and counting unit 55.

In this embodiment, the stackers 60*a* to 60*d*, the rejection units 61*a* and 61*b*, the bundling unit 250, the transport unit 70, and the cassette storing unit 300 correspond to the "handling unit" recited in the claims. However, elements included in the "handling unit" are not limited to the aforementioned ones. The "handling unit" also includes elements not included in the embodiment. For example, the handling unit may include a large bundle forming unit 500 (see FIG. 4) for strapping, for example, 10 100-paper-sheet bundles (1000 paper sheets) with tape or wrapping material, and a cutting unit 550 (see FIG. 5) for cutting paper sheets. A transport unit not shown in the drawings transports, for example, 10 100-paper-sheet bundles from the paper sheet bundle stacking unit 270 to the large bundle forming unit 500. The large bundle forming unit may be formed as an independent large bundle forming apparatus that connects to a plurality of paper sheet handling machines 100 by means of a bundle transport mechanism such as a belt conveyor to form a paper sheet handling system (see PCT/JP2012/064826). In this paper sheet handling system, the 100-paper-sheet bundles made by the paper sheet handling machine 100 are transported by the bundle transport mechanism to the large bundle forming apparatus where 10 100-paper-sheet bundles are strapped. In this paper sheet handling system, the large bundle forming apparatus is included in the "handling unit." The paper sheet handling machine 100 in this paper sheet handling system may be configured to allow the confirmation signal to be accepted on the condition that the recognizing and counting unit 55 recognized the "last paper sheet." The paper sheets such as banknotes bundled by the large bundle forming unit 500 or the large bundle forming apparatus are used as the refill of ATMs, for example.

As shown in FIG. 2, the paper sheet handling machine 100 according to the embodiment also includes a control unit 50 for controlling and acquiring information from other elements included in the paper sheet handling machine 100. The control unit 50 according to the embodiment connects to the taking-in unit 10, the transport unit 70, the long edge reversing unit 90, the short edge reversing unit 95, the bundling unit 250, the pre-before-bundling-paper-sheet transporting unit 220, the bundled paper sheet transporting unit 260, the cassette storing unit 300, the stackers 60*a* to 60*d*, the rejection units 61*a* and 61*b*, the memory unit 56, the recognizing and counting unit 55, the operation/display unit 59, the notification unit 57, the diverter members 71, and the sensors 72.

The embodiment has been mainly described for the aspect in which the paper sheet handling system means the paper sheet handling machine 100 itself. However, the embodiment is not limited to this aspect. For example, the input unit, the memory unit, and the notification unit may be separated from the paper sheet handling machine 100. Alternatively, one of, two of, or all of the input unit, the memory unit, and the notification unit may be separated from the paper sheet handling machine 100, and included in a management apparatus 400 for managing the paper sheet handling machine 100 (see FIG. 3). These modifications are based on the idea that the "paper sheet handling system" recited in the claims may mean the paper sheet handling machine 100 itself or a combination of the paper sheet handling machine 100 and other machines, as has been described before.

Figure 3:
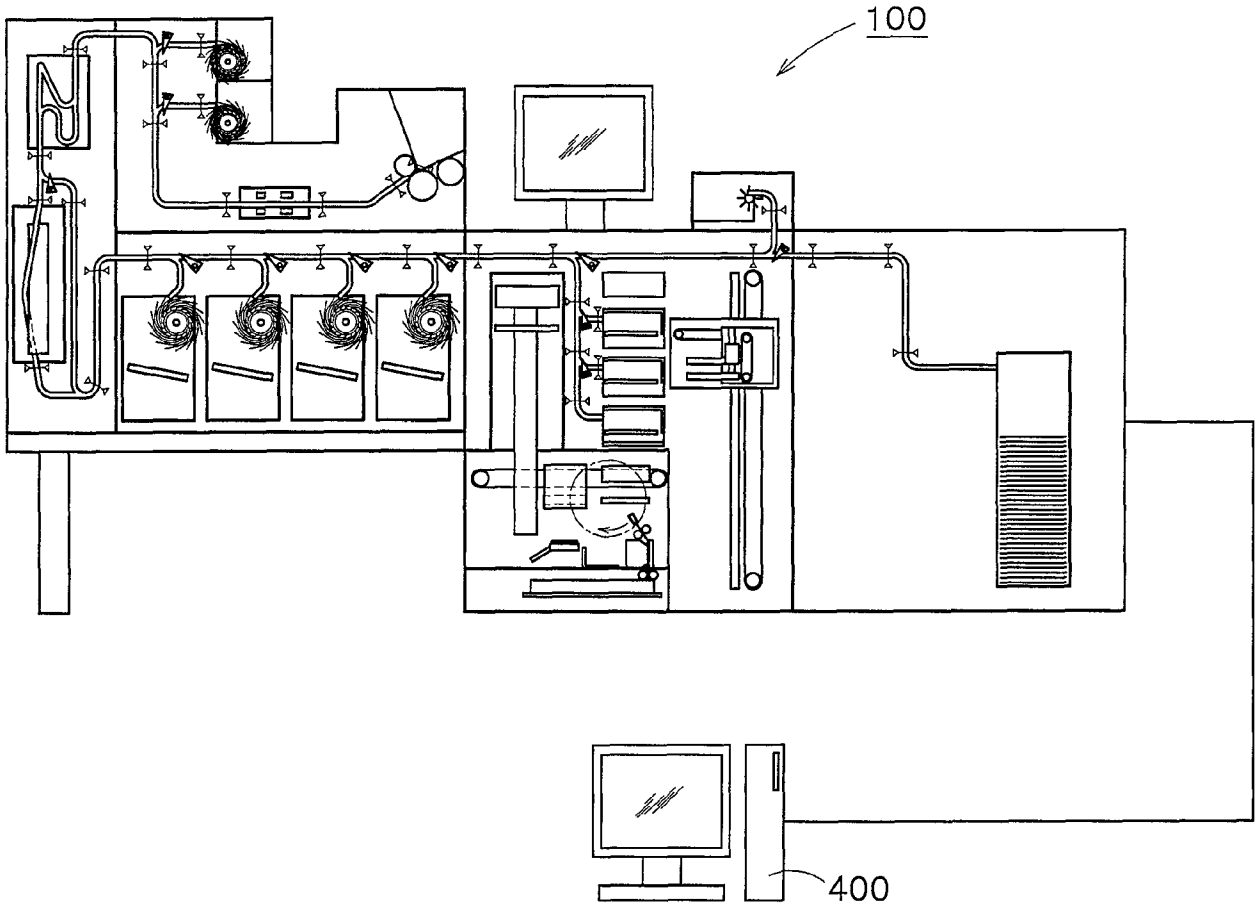
FIG. 3 is a diagram illustrating the structure of the paper sheet handling system according to the embodiment of the present invention.
Figure 4:
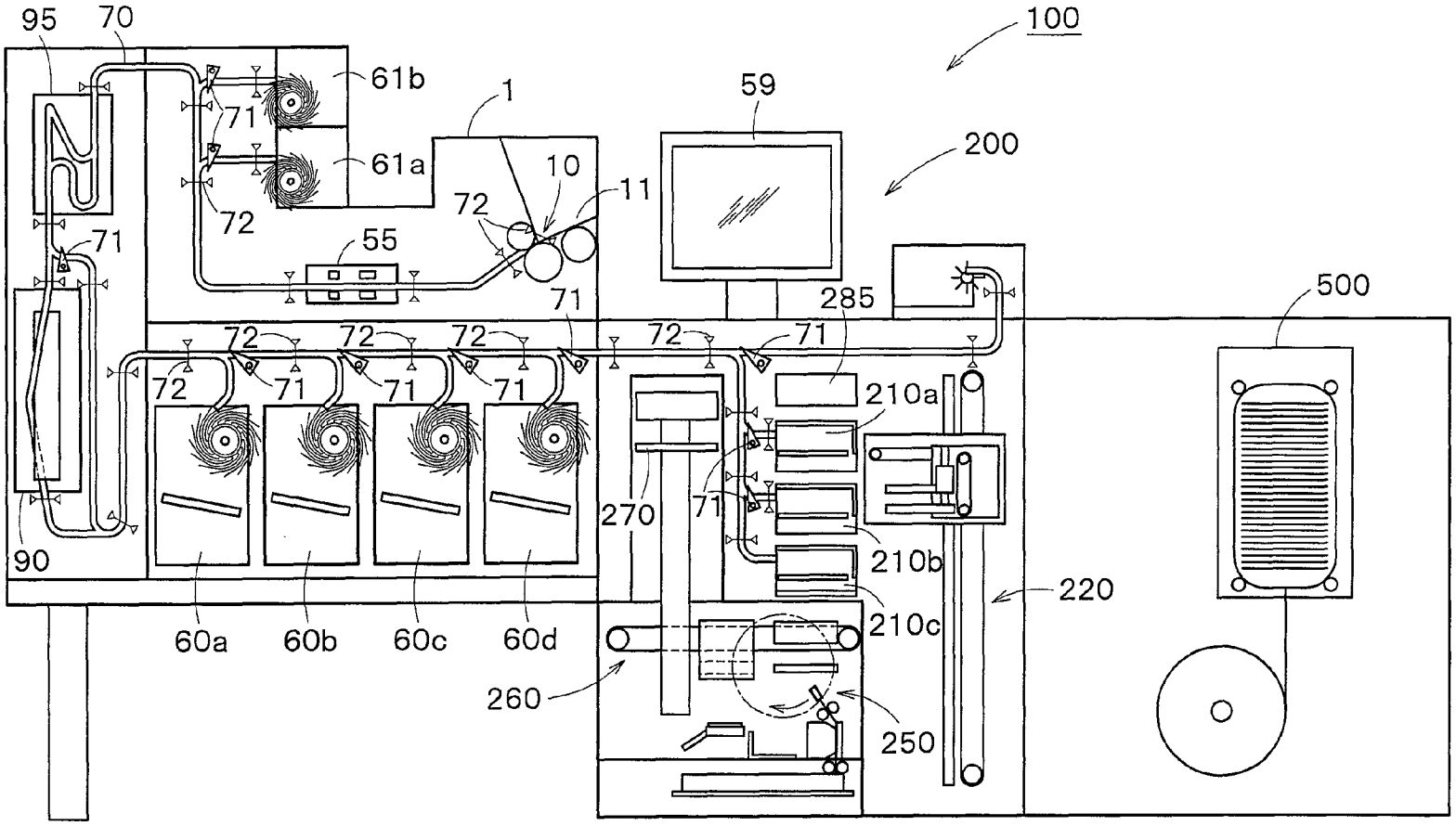
FIG. 4 is a side cross-section of a paper sheet handling machine according to a modification of the embodiment of the present invention, illustrating the structure thereof.
Figure 5:
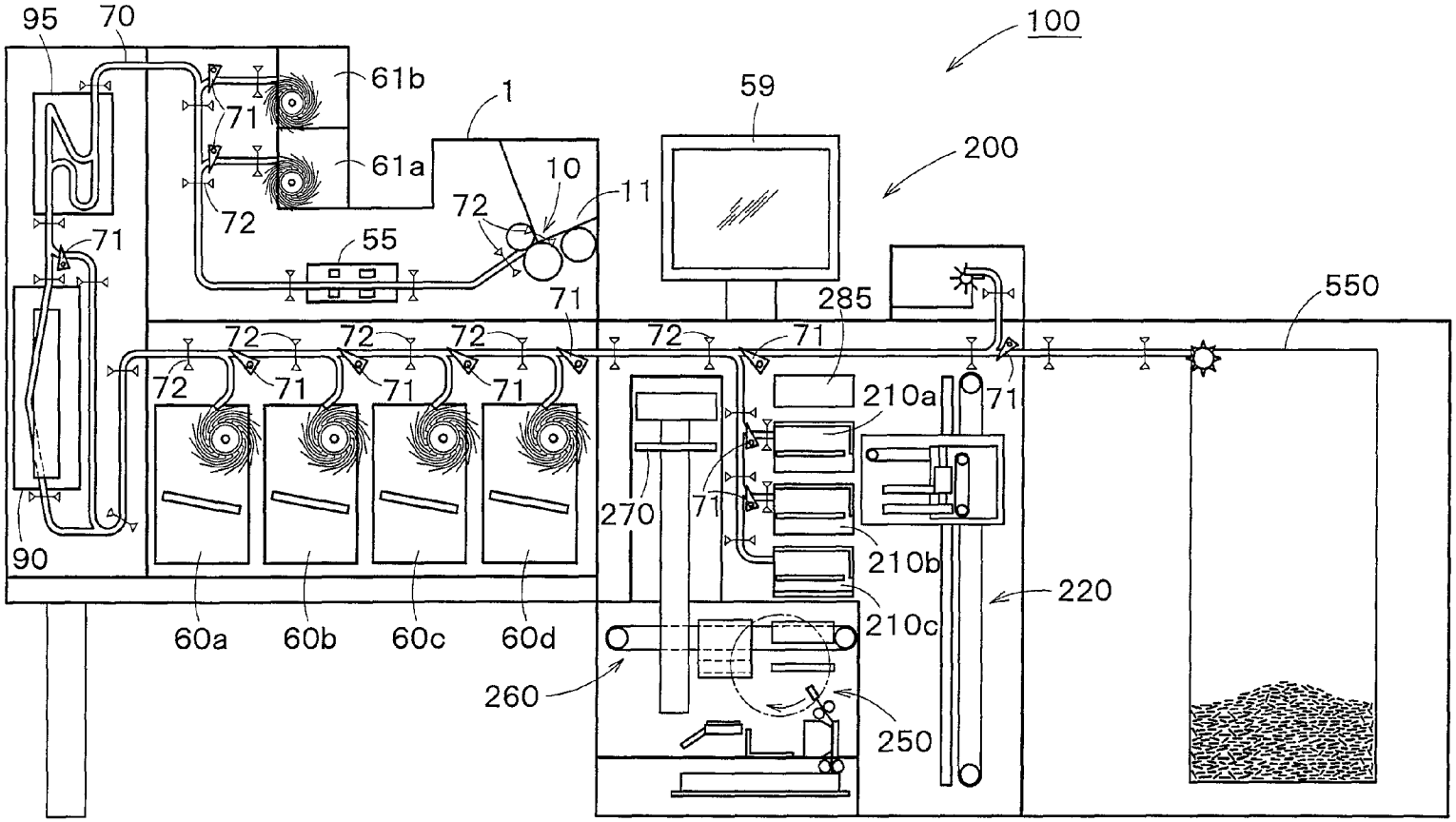
FIG. 5 is a side cross-section of a paper sheet handling machine according to another modification of the embodiment of the present invention, illustrating the structure thereof.

If the paper sheet handling system includes the management apparatus 400 as shown in FIG. 3, the paper sheet handling machine 100 may send a notification indicating that the condition for accepting the confirmation signal is met to the management apparatus 400, or the management apparatus 400 may acquire information from the paper sheet handling machine 100 at regular intervals to in order for the management apparatus 400 to determine whether the condition is met to accept the confirmation signal.

<<Method>>

The process of handling the paper sheets by means of the paper sheet handling machine 100 will be briefly described below.

First, a plurality of paper sheets are placed in and received by the reception unit 11.

Next, the taking-in unit 10 takes in the paper sheets, one by one, to the housing 1 automatically or when a start button is pressed.

The paper sheets taken in by the housing 1 are transported by the transport unit 70, recognized and counted by the recognizing and counting unit 55, and then stored, based on the denominations, in the storage unit including the stackers 60*a* to 60*d*, the paper-sheet-to-be-bundled stacking units 210*a* to 210*c*, and the cassette 310. The paper sheets not transported to the stackers 60*a* to 60*d* due to such reasons as abnormal recognition and transport trouble are transported to the rejection units 61*a* and 61*b*.

When at least the condition that "the last paper sheet" is recognized by the recognizing and counting unit 55 is met, a confirmation signal for confirming the transaction data with respect to the paper sheets recognized by the recognizing and counting unit 55 is inputted from the operation/display unit 59.

Assuming that the confirmation signal is accepted only on the condition that the recognizing and counting unit 55 recognizes the last paper sheet, the process will be briefly described below.

When the paper sheets received by the reception unit 11 are transported to the storage unit including the stackers 60*a* to 60*d*, the paper-sheet-to-be-bundled stacking units 210*a* to 210*c*, and the cassette 310 to perform a deposit operation, immediately after the last paper sheet among the paper sheets received by the reception unit 11 is recognized by the recognizing and counting unit 55, the confirmation signal may be inputted from the operation/display unit 59. If additional paper sheets are received by the reception unit 11 before the confirmation signal is inputted, the control unit 50 determines that the deposit operation continues, and the confirmation signal is prevented from being inputted. Therefore, the deposit operation may be resumed. When the last paper sheet of the paper sheets received by the reception unit 11 is recognized by the recognizing and counting unit 55, the confirmation signal is allowed to be inputted again.

In the aforementioned case, if the paper sheets received by the reception unit 11 are transported to the storage unit including the stackers 60*a* to 60*d*, the paper-sheet-to-be-bundled stacking units 210*a* to 210*c*, and the cassette 310 to perform a withdrawal operation, the confirmation signal is allowed to be inputted from the operation/display unit 59 immediately after the total amount of the paper sheets recognized by the recognizing and counting unit 55 reaches a predetermined amount.

If the conditions that there is no rejected paper sheet in the rejection units 61*a* and 61*b*, that transaction information is inputted, and that the last paper sheet passes through a predetermined transport point are set in order to accept the confirmation signal from the operation/display unit 59, the confirmation signal from the operation/display unit 59 is accepted only when these conditions are met.

As described above, the count data relating to the ongoing transaction is confirmed when the operator inputs a confirmation signal from the operation/display unit 59. Thereafter, the next transaction information, for example, may be inputted from the operation/display unit 59.

If the paper sheets such as banknotes are rejected during the deposit operation, correct count data of this transaction may be stored in the memory unit 56 by manually inputting the number of paper sheets such as banknotes in each denomination from the operation/display unit 59, or causing the paper sheet handling machine 100 to re-recognize and re-count the rejected paper sheets such as banknotes.

If an error is caused by a paper jam during the deposit operation or withdrawal operation, all of the paper sheets stored in the storage unit including the stackers 60*a* to 60*d*, the paper-sheet-to-be-bundled stacking units 210*a* to 210*c*, and the cassette 310, and the paper sheets remaining in the transport unit 70 may be taken out, and re-recognized and re-counted by the paper sheet handling machine 100. In this case, only the confirmed paper sheets may be stored in the storage unit, such as the stackers 60*a* to 60*d*, and the paper sheets that have not been confirmed may be transported to the rejection units 61*a* and 61*b*.

If the aspect including the notification unit 57 is employed, when the input of a confirmation signal from the operation/display unit 59 is ready, the notification unit 57 (or operation/display unit 59) notifies this state. When the input of confirmation signal is received from the operation/display unit 59, the notification unit 57 (or operation/display unit 59) notifies that the paper sheets may be received by the reception unit 11.

Thereafter, the aforementioned process is performed on the paper sheets in each transaction.

<<Function and Effect>>

The function and the effect of the embodiment including the aforementioned elements will be described below.

According to the embodiment, the confirmation signal from the operation/display unit 59 is accepted on the condition that the last paper sheet is recognized by the recognizing and counting unit 55. Therefore, even before the process in the handling unit is completed in the paper sheet handling machine 100, paper sheets for a new transaction may be deposited, and transaction data relating to the new transaction may be inputted. This improves the work efficiency in the deposit operation and the withdrawal operation.

This will be described below.

In conventional paper sheet handling machines, the amount of deposited paper sheets cannot be confirmed until the processes in the handling unit that the deposited paper sheets are stacked in a stacker and that the paper sheets are bundled in a bundling unit are completed. In order to reliably confirm the deposited amount in one transaction, the conventional paper sheet handling machines do not start a new transaction until the deposit amount of the deposited paper sheets is confirmed. Since the new transaction cannot start before the stacking operation and the bundling operation are completed, the conventional paper sheet handling machines have not been able to achieve a high work efficiency. In particular, the bundling operation takes a long time (about one minute) before being completed, makes the work efficiency low.

In contrast, in the embodiment, the confirmation signal from the operation/display unit 59 is accepted on the condition that the last paper sheet is recognized by the recognizing and counting unit 55. Therefore, the confirmation signal from the operation/display unit 59 may be accepted when the last paper sheet is recognized by the recognizing and counting unit 55. As a result, a new transaction can be started before the stacking operation or the bundling operation is completed, while the stackers 60*a* to 60*d* are stacking the paper sheets, the bundling unit 250 is bundling a predetermined number of paper sheets, the transport unit 70 is transporting the paper sheets, or the cassette storing unit 300 is stacking the paper sheets. Therefore, a high work efficiency can be achieved.

The decrease in work efficiency caused by not being able to start a new transaction has been a big problem in paper sheet handling centers that handle, at a time, paper sheets relating to a number of transactions, such as banking centers that collect banknotes from a plurality of bank branches, and banknote collect centers that collect banknotes from a plurality of customers through security and transport firms. The use of the paper sheet handling system according to the embodiment in these paper sheet handling centers may produces a remarkable effect.

In conventional machines in which a printing apparatus such as a printer is connected to a paper sheet handling machine, the confirmation signal may not be accepted until the printing operation is completed by the printing machine. In this case, it takes a long time to accept the confirmation signal. In particular, when the printing machine is out of paper, it takes a very long time to accept the confirmation signal. According to the embodiment, a new transaction can be started before the completion of the printing operation by the printing machine. This greatly improves the efficiency as compared to conventional machines. This printing machine is also included in the "handling unit" recited in the claims.

If the condition that no rejected paper sheet is present in the rejection units 61*a* and 61*b* is employed to accept the confirmation signal from the operation/display unit 59, the operator may not be able to input the confirmation signal from the operation/display unit 59 as long as the rejected paper sheets stay in the rejection units 61*a* and 61*b*. Therefore, in such an aspect, the number of banknotes in each denomination, actually stacked in the stackers 60*a* to 60*d*, may be reliably caused to match the number of banknotes in each denomination recognized by the recognizing and counting unit 55, and the number of paper sheets in each denomination to be deposited may be reliably caused to match the number of paper sheets in each denomination recognized and counted by the recognizing and counting unit 55 and stacked in the storage unit such as the stackers 60*a* to 60*d*.

This will be described below. The paper sheets recognized by the recognizing and counting unit 55 may be rejected due to abnormal transport conditions and transported to the rejection units 61*a* and 61*b*. If only the condition that the last paper sheet is recognized by the recognizing and counting unit 55 is employed to accept the confirmation signal from the operation/display unit 59, there is a possibility that the operator may input the confirmation signal from the operation/display unit 59 without checking the presence of paper sheets in the rejection units 61*a* and 61*b*. In such a case, the number of paper sheets in each denomination recognized and counted by the recognizing and counting unit 55 may differ from the number of paper sheets in each denomination actually stacked in the storage unit such as the stackers 60*a* to 60*d*. If the condition that no rejected paper sheet is present in the rejection units 61*a* and 61*b* is also employed, the above case may be prevented.

In a deposit operation, if the operator inputs a confirmation signal from the operation/display unit 59 without checking whether there is a paper sheet rejected and transported to the rejection units 61*a* and 61*b* due to abnormal recognition conditions, the number of paper sheets in each denomination to be deposited may differ from the number of paper sheets in each denomination recognized and counted by the recognizing and counting unit 55 and stacked in the storage unit including the stackers 60*a* to 60*d*. If the condition that no rejected paper sheet is present in the rejection units 61*a* and 61*b* is also employed, the above case may be prevented.

If the condition that transaction information is inputted is employed to accept the confirmation signal from the operation/display unit 59 in this embodiment, the deposit information and the withdrawal information on the paper sheets may be allowed to be confirmed in association with the transaction information including the transaction ID, the name of depositor, the account number relating to the deposit, the total amount of the paper sheets, and the number of paper sheets in each denomination.

If the transaction information includes the total amount of the paper sheets to be deposited and the number of paper sheets in each denomination, whether the total number of paper sheets recognized by the recognizing and counting unit 55 and the number of paper sheets in each denomination match the total amount of paper sheets and the number of paper sheets in each denomination in the transaction information may be checked, and the confirmation signal from the operation/display unit 59 may be allowed to be accepted only when the total number of paper sheets and the number of paper sheets in each denomination match. According to this aspect, the process may be confirmed after the total amount of the paper sheets and the number of paper sheets in each denomination stored in the storage unit such as the stackers 60*a* to 60*d* match those included in the transaction information.

If the conditions that no rejected paper sheet is present in the rejection units 61*a* and 61*b* and that the transaction information is inputted are employed to accept the confirmation signal from the operation/display unit 59, the effects of both the aforementioned two aspects may be obtained.

Even if the condition that the transaction information is inputted is employed to accept the confirmation signal from the operation/display unit 59, a new transaction may be started without waiting for the completion of the stacking operation in the stackers 60*a* to 60*d* and the cassette storing unit 300 and the bundling operation in the bundling unit 25. Therefore, a high work efficiency may be achieved.

If the condition that no rejected paper sheet is present in the rejection units 61*a* and 61*b* is employed to accept the confirmation signal from the operation/display unit 59, a high work efficiency may be achieved since it is not necessary to wait for the completion of the operation such as the bundling operation of the deposited paper sheets in the bundling unit 250.

If an aspect of the embodiment is employed in which the notification unit 57 (or operation/display unit 59) provides a notification when the confirmation signal from the operation/display unit 59 is acceptable, the operator's work efficiency may be improved since the operator is allowed to input the confirmation signal without delay.

If an aspect of the embodiment is employed, in which when the input of the confirmation signal at the operation/display unit 59 is accepted, the notification unit 57 (or operation/display unit 59) provides a notification that the paper sheets may be received by the reception unit 11, even immature operators may immediately understand what to do next. Therefore, the work efficiency of such immature operators may be improved.

The above descriptions of the embodiment and the disclosure of the drawings indicate only examples of the claimed inventions, and do not limit the claimed inventions.

EXPLANATION OF REFERENCES

10: taking-in unit
11: reception unit
55: recognizing and counting unit
56: memory unit
59: operation/display unit (input unit)
60*a*-60*d*: stacker
61*a*, 61*b*: rejection unit
70: transport unit
100: paper sheet handling machine
200: paper sheet bundling unit

250: bundling unit
300: cassette storing unit
310: cassette
400: management apparatus
500: large bundle forming unit
550: cutting unit

The invention claimed is:

1. A paper sheet handling system comprising:

a reception unit configured to receive a plurality of paper sheets;

a taking-in unit configured to take in, one by one, the paper sheets received by the reception unit;

a recognizing and counting unit configured to recognize and count the paper sheets taken in by the taking-in unit;

a handling unit configured to handle each of the paper sheets recognized by the recognizing and counting unit;

an input unit configured to input a confirmation signal to confirm count data relating to each of the paper sheets recognized by the recognizing and counting unit; and a notification unit configured to provide a notification indicating that the confirmation signal from the input unit can be accepted, wherein the confirmation signal from the input unit is accepted on a condition that a last paper sheet is recognized by the recognizing and counting unit.

2. The paper sheet handling system according to claim 1, further comprising:

a rejection unit configured to store a rejected paper sheet, wherein the confirmation signal from the input unit is accepted on a condition that no rejected paper sheet is present in the rejection unit.

3. The paper sheet handling system according to claim 1, wherein the input unit is configured to input transaction information on each of the paper sheets that is received or to be received by the reception unit, and the confirmation signal from the input unit is accepted on a condition that the transaction information is inputted.

4. The paper sheet handling system according to claim 1, wherein the handling unit includes a stacker configured to stack and store each of the paper sheets, and the confirmation signal inputted from the input unit is accepted while the paper sheets are being stacked by the stacker.

5. The paper sheet handling system according to claim 1, wherein the handling unit includes a bundling unit configured to bundle a predetermined number of paper sheets, and the confirmation signal from the input unit is accepted while the paper sheets are being bundled by the bundling unit.

6. The paper sheet handling system according to claim 1, wherein the handling unit includes a transport unit configured to transport the paper sheets, and the confirmation signal inputted from the input unit is accepted while the paper sheets are being transported by the transport unit.

7. The paper sheet handling system according to claim 1, wherein the handling unit includes a storage unit configured to store the paper sheets, and when each of the paper sheets received by the reception unit is transported to the storage unit to perform a deposit operation, a paper sheet received by the reception unit and taken in by the taking-in unit in the last place corresponds to the last paper sheet.

8. The paper sheet handling system according to claim 1, wherein the handling unit includes a storage unit configured to store the paper sheets, and when each of the paper sheets received by the reception unit is transported to the storage unit to perform a withdrawal operation, a paper sheet with which the total amount of the paper sheets recognized by the recognizing and counting unit reaches the predetermined amount is the last paper sheet.

9. A paper sheet handling system comprising:

a reception unit configured to receive a plurality of paper sheets;

a taking-in unit configured to take in, one by one, the paper sheets received by the reception unit;

a recognizing and counting unit configured to recognize and count the paper sheets taken in by the taking-in unit;

a handling unit configured to handle each of the paper sheets recognized by the recognizing and counting unit; and an input unit configured to input a confirmation signal to confirm count data relating to each of the paper sheets recognized by the recognizing and counting unit; and a notification unit configured to provide, when the confirmation signal from the input unit is accepted, a notification indicating that the paper sheets can be received by the reception unit, wherein the confirmation signal from the input unit is accepted on a condition that a last paper sheet is recognized by the recognizing and counting unit.

10. The paper sheet handling system according to claim 9, further comprising:

a rejection unit configured to store a rejected paper sheet, wherein the confirmation signal from the input unit is accepted on a condition that no rejected paper sheet is present in the rejection unit.

11. The paper sheet handling system according to claim 9, wherein the input unit is configured to input transaction information on each of the paper sheets that is received or to be received by the reception unit, and the confirmation signal from the input unit is accepted on a condition that the transaction information is inputted.

12. The paper sheet handling system according to claim 9, wherein the handling unit includes a stacker configured to stack and store each of the paper sheets, and the confirmation signal inputted from the input unit is accepted while the paper sheets are being stacked by the stacker.

13. The paper sheet handling system according to claim 9, wherein the handling unit includes a bundling unit configured to bundle a predetermined number of paper sheets, and the confirmation signal from the input unit is accepted while the paper sheets are being bundled by the bundling unit.

14. The paper sheet handling system according to claim 9, wherein the handling unit includes a transport unit configured to transport the paper sheets, and the confirmation signal inputted from the input unit is accepted while the paper sheets are being transported by the transport unit.

15. The paper sheet handling system according to claim 9, wherein the handling unit includes a storage unit configured to store the paper sheets, and when each of the paper sheets received by the reception unit is transported to the storage unit to perform a deposit operation, a paper sheet received by the reception unit and taken in by the taking-in unit in the last place corresponds to the last paper sheet.

16. The paper sheet handling system according to claim 9, wherein the handling unit includes a storage unit configured to store the paper sheets, and when each of the paper sheets received by the reception unit is transported to the storage unit to perform a withdrawal operation, a paper sheet with which the total amount of the paper sheets recognized by the recognizing and counting unit reaches the predetermined amount is the last paper sheet.

* * * * *